US011511245B2

(12) United States Patent
Morinaga et al.

(10) Patent No.: US 11,511,245 B2
(45) Date of Patent: Nov. 29, 2022

(54) STIRRING DEVICE

(71) Applicant: SUMITOMO HEAVY INDUSTRIES PROCESS EQUIPMENT CO., LTD., Ehime (JP)

(72) Inventors: Shoji Morinaga, Ehime (JP); Tetsuya Miyata, Ehime (JP); Katsuhide Takenaka, Ehime (JP)

(73) Assignee: SUMITOMO HEAVY INDUSTRIES PROCESS EQUIPMENT CO., LTD., Ehime (JP)

( * ) Notice: Subject to any disclaimer, the term of this patent is extended or adjusted under 35 U.S.C. 154(b) by 203 days.

(21) Appl. No.: 16/848,998

(22) Filed: Apr. 15, 2020

(65) Prior Publication Data

US 2020/0238234 A1 Jul. 30, 2020

Related U.S. Application Data

(63) Continuation of application No. PCT/JP2018/041074, filed on Nov. 6, 2018.

(30) Foreign Application Priority Data

Nov. 8, 2017 (JP) ..... JP2017-215575

(51) Int. Cl.
*B01F 27/1125* (2022.01)
*B01F 27/1145* (2022.01)
(Continued)

(52) U.S. Cl.
CPC ..... *B01F 27/11451* (2022.01); *B01F 23/41* (2022.01); *B01F 23/43* (2022.01);
(Continued)

(58) Field of Classification Search
CPC ..... B01F 3/0807; B01F 3/0853; B01F 7/26; B01F 7/247; B01F 7/246; B01F 7/166;
(Continued)

(56) References Cited

U.S. PATENT DOCUMENTS 2,390,898 A * 12/1945 Rechtin ..... B01F 27/8111 241/257.1
2,450,802 A * 10/1948 Johnson ..... B01F 27/8111 366/264

(Continued)

FOREIGN PATENT DOCUMENTS

CH 353724 A 4/1961
CH 360268 A 2/1962

(Continued)

OTHER PUBLICATIONS

Shimada Takafumi, Translated Patent Application of JP-03016629-A (Year: 1991).*

(Continued)

*Primary Examiner* — Walter D. Griffin
*Assistant Examiner* — Noor F Ahmad
(74) *Attorney, Agent, or Firm* — Michael Best & Friedrich LLP

(57) ABSTRACT

There is provided a stirring device including a stirring tank including an inner peripheral wall which is circular in cross section, at least one circulating impeller and at least one dispersion blade which are located inside the stirring tank and rotatable around a vertical axis independently of each other, and a guide ring disposed radially outward near the dispersion blade. The circulating impeller is disposed along the inner peripheral wall of the stirring tank, and rotates around the vertical axis to form at least a downward flow in a stirring object existing inside the stirring tank. The dispersion blade rotates to apply a shear force to the stirring object, and is disposed at a radially inner position of the stirring tank from the circulating impeller, and at a position in contact with a flow of the stirring object, which is formed by the circulating impeller.

10 Claims, 13 Drawing Sheets

(51) Int. Cl.

| | |
|---|---|
| ***B01F 23/41*** | (2022.01) |
| ***B01F 23/43*** | (2022.01) |
| ***B01F 27/86*** | (2022.01) |
| *B01F 101/06* | (2022.01) |
| *B01F 101/21* | (2022.01) |

(52) U.S. Cl.
CPC ..... *B01F 27/1125* (2022.01); *B01F 27/86* (2022.01); *B01F 2101/06* (2022.01); *B01F 2101/21* (2022.01)

(58) Field of Classification Search
CPC ..... B01F 7/1635; B01F 7/00466; B01F 7/00458; B01F 7/1675; B01F 7/00291; B01F 7/00441; B01F 15/065; B01F 2215/0431; B01F 2215/0031; B01F 2215/0014; B01F 2101/06; B01F 2101/21; B01F 23/41; B01F 23/43; B01F 27/1125; B01F 27/11451; B01F 27/1151; B01F 27/1152; B01F 27/8111; B01F 27/84; B01F 27/86; B01F 27/9213; B01F 27/9214; B01F 27/93; B01F 35/92
USPC ..... 366/257, 292, 293, 314
See application file for complete search history.

(56) References Cited

U.S. PATENT DOCUMENTS

| | | | | | |
|---|---|---|---|---|---|
| 2,578,805 | A * | 12/1951 | Johnson | ..... | B01F 27/8111 241/46.11 |
| 3,392,963 | A | 7/1968 | Van Dierendonck et al. | | |
| 5,972,661 | A * | 10/1999 | Kubera | ..... | B01F 3/04609 261/123 |
| 9,643,336 | B1 | 5/2017 | Krivohlavek | | |
| 10,478,791 | B2 | 11/2019 | Morinaga et al. | | |
| 2010/0331488 | A1* | 12/2010 | Saita | ..... | B01F 7/18 524/878 |
| 2011/0144384 | A1* | 6/2011 | Piras | ..... | B01J 19/0066 562/414 |
| 2017/0326516 | A1* | 11/2017 | Mortensen | ..... | B01F 7/30 |

FOREIGN PATENT DOCUMENTS

| | | | | | |
|---|---|---|---|---|---|
| CN | 202844952 | U | | 4/2013 | |
| CN | 103432947 | A | | 12/2013 | |
| DE | 582863 | C | | 8/1933 | |
| JP | S57-045333 | A | | 3/1982 | |
| JP | S58-128621 | U | | 8/1983 | |
| JP | H02133425 | U | * | 11/1990 | ..... B01J 19/0066 |
| JP | 03016629 | A | * | 1/1991 | ..... B01J 19/0066 |
| JP | H04-029733 | A | | 1/1992 | |
| JP | H06-134274 | A | | 5/1994 | |
| JP | H06-343846 | A | | 12/1994 | |
| JP | 2017-215575 | A | | 12/2017 | |
| WO | WO-2017/002905 | A1 | | 1/2017 | |

OTHER PUBLICATIONS

Article 94(3) EPC communication issued in European Application No. 18875038.4, dated Nov. 30, 2020.
Search Report issued in European Application No. 18875038.4, dated Nov. 16, 2020.
International Search Report issued in Application No. PCT/JP2018/041074, dated Jan. 15, 2019.

* cited by examiner

STIRRING DEVICE

RELATED APPLICATIONS

The contents of Japanese Patent Application No. 2017-215575, and of International Patent Application No. PCT/JP2018/041074, on the basis of each of which priority benefits are claimed in an accompanying application data sheet, are in their entirety incorporated herein by reference).

BACKGROUND

Technical Field

Certain embodiments of the present invention relate to a stirring device suitable for stirring a fluidic stirring object having a specific viscosity.

Description of Related Art

For example, in order to form an emulsified liquid used for hair care products or skin care products, that is, an emulsified liquid in which an oil phase (for example, silicone oil) is refined to be dispersed into an aqueous phase, an emulsification method for applying a shear force to the oil phase to refine the oil phase is known. For the emulsified liquid, a stable state where dispersed particles are not separated needs to be maintained over a long period of time. In a case of a low-viscosity emulsified liquid, the dispersed particles need to have a submicron particle size or a smaller particle size.

There are various types as an emulsification device for performing emulsification. For example, a rotor-stator type device is used as a high-shear blade used for applying the shear force to the oil phase and used for producing the low-viscosity emulsified liquid.

As the device used for producing a high-viscosity emulsified liquid, there is a device in the related art disclosed by the present applicant. This device is configured as follows. A ribbon impeller that performs entire circulation inside tank supplies a liquid to a dispersion blade that rotates at a high speed. The shear force can be applied to the liquid from the dispersion blade. According to this configuration, it is possible to refine an ultra-high-viscosity stirring object which is less likely to be refined in the related art.

SUMMARY

According to an embodiment of the present invention, there is provided a stirring device including a stirring tank including an inner peripheral wall which is circular in cross section, at least one circulating impeller and at least one dispersion blade which are located inside the stirring tank and rotatable around a vertical axis independently of each other, and a guide ring disposed near a radially outer side of the dispersion blade. Rotation centers of the circulating impeller and the dispersion blade are concentric with each other. The circulating impeller is disposed along the inner peripheral wall of the stirring tank, and rotates around the vertical axis to format least a downward flow in a stirring object existing inside the stirring tank. The dispersion blade rotates to apply a shear force to the stirring object, and is disposed at a radially inner position of the stirring tank from the circulating impeller, and at a position in contact with a flow of the stirring object, which is formed by the circulating impeller. The guide ring includes an inner peripheral surface facing an outer peripheral edge of the dispersion blade.

DETAILED DESCRIPTION

Figure 1:
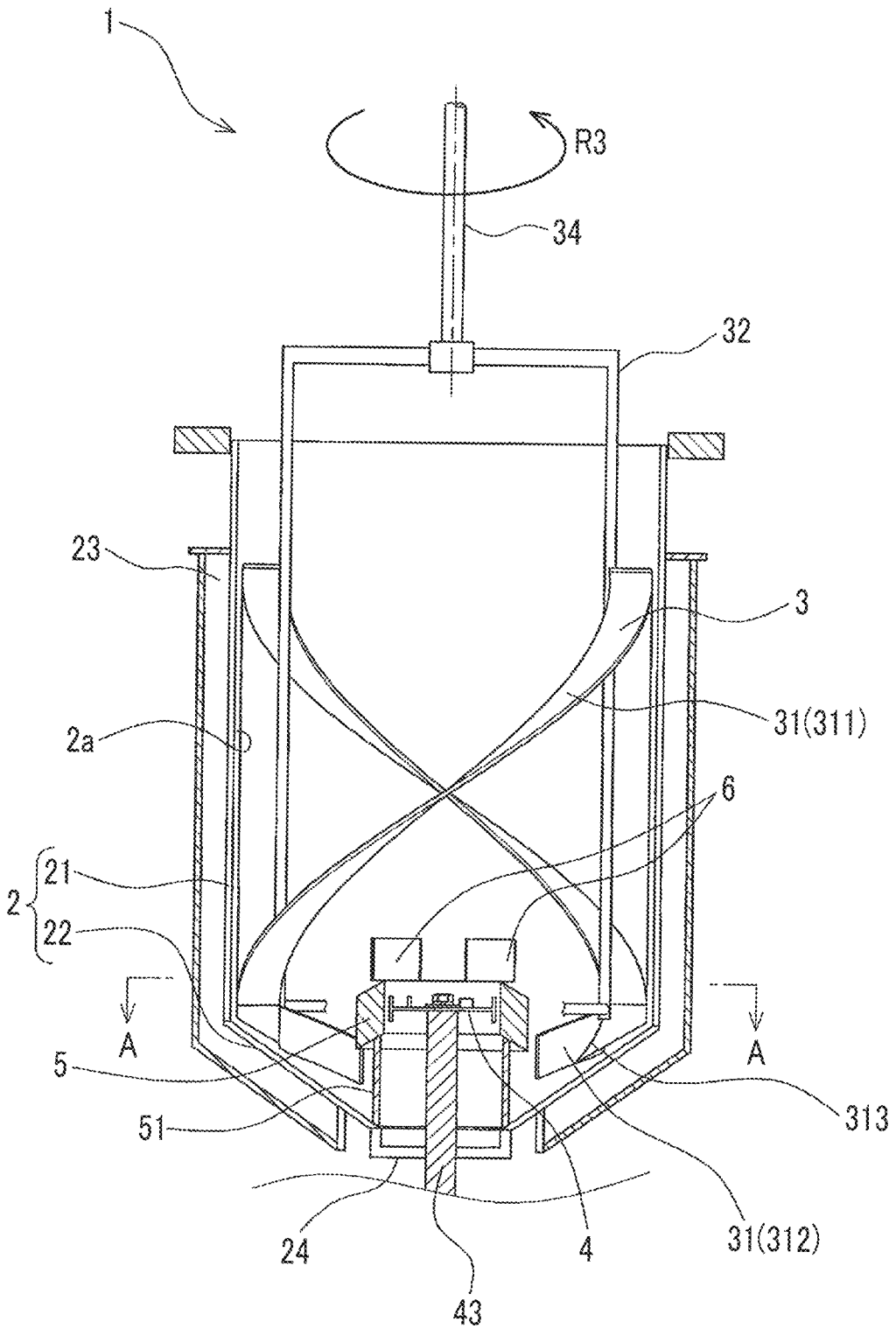
FIG. 1 is a partial longitudinal sectional view illustrating a stirring device according to an embodiment of the present invention.

In the rotor-stator type device, a vane rotates at a high speed as in a centrifugal pump to suction the liquid and to discharge the liquid. The rotor-stator type device has a function of applying the shear force to the liquid by rotating at the high speed while circulating the liquid. However, as in a case of the centrifugal pump, when a viscosity of the liquid increases, a negative pressure portion is generated on a rear side of the vane, thereby causing a so-called "cavitation phenomenon" to occur. Consequently, an application limit is a viscosity of approximately 1,000 cP. Therefore, in a case where the viscosity is 10,000 cP or higher, the stirring object is not continuously supplied (suctioned) into the device, and a phenomenon occurs in which the device "idles".

According to the device disclosed in the related art, an emulsification operation can be performed to some extent in a case where the viscosity is lower than 10,000 cP. However, the inventor of the present application has found the followings. When a specific emulsification operation is performed using the device, the dispersed particles are less likely to be separated over a long period of time. Consequently, the device is insufficient in producing a stable emulsified liquid. The reason is considered as follows. It is assumed that the stirring object of the device has an ultra-high viscosity exceeding 100,000 cP. When the viscosity is lower than the assumed viscosity, the shear force is not sufficiently applied to the stirring object. Accordingly, the stirring object is insufficiently refined. The reason is also considered as follows. Since the viscosity is relatively low, compared to the ultra-high-viscosity stirring object, a discharge amount from the dispersion blade increases due to the low viscosity. On the other hand, a supply flow rate from the ribbon impeller decreases. Accordingly, a flow of the stirring object inside tank becomes unbalanced.

As described above, a stirring (emulsification) device suitable for the stirring object having a high viscosity, specifically, a viscosity of 10,000 cP to 100,000 cP (viscosity in this range is defined as a "high viscosity" in the present application) does not exist in the related art.

Under the above-described circumstances, in a jobsite for performing the emulsification operation, in some cases, the emulsification operation is performed in a state where the viscosity of the stirring object is lowered by raising an operation temperature once. However, when this emulsification operation is performed, there is a disadvantage in that a large amount of power and a longer processing time are required for heating and cooling, or there is a disadvantage in that a long time is required for cleaning work after the operation since the number of components in the device increases. Therefore, it is desirable to use a device capable of performing the emulsification operation at a room temperature as it is.

There is a need for a stirring device particularly suitable for a high-viscosity stirring object.

In addition, the dispersion blade may include a rotating plate-shaped part, shear teeth disposed in an outer peripheral edge of the plate-shaped part at an interval in a circumferential direction, and at least one fin part protruding at least upward or downward from the plate-shaped part.

In addition, the dispersion blade may include at least one through-hole adjacent to the fin part and penetrating the plate-shaped part.

In addition, a vertical dimension on the inner peripheral surface of the guide ring may be larger than a vertical dimension in the outer peripheral edge of the dispersion blade.

In addition, the stirring device may further include a baffle located above or below the guide ring. The baffle may guide the stirring object to which the shear force is applied by the dispersion blade, to a radially outer position from an area surrounded by the inner peripheral surface of the guide ring.

In addition, a radial distance between the outer peripheral edge of the dispersion blade and the inner peripheral surface of the guide ring may exceed 0%, and may be equal to or smaller than 10% of a diameter of the inner peripheral wall in the stirring tank.

In addition, a vertical dimension on the inner peripheral surface of the guide ring may exceed 0%, and may be equal to or smaller than 25% of a diameter of the inner peripheral wall in the stirring tank.

Hereinafter, a stirring device according to an embodiment of the present invention will be described. A preferred application of a stirring device 1 according to the present embodiment is emulsification, and the emulsification will be described below. However, the application of the stirring device 1 is not limited only to the emulsification, and the stirring device 1 is applicable to various applications. As a stirring object in a case of the emulsification, for example, various materials for cosmetics (hair care products, skin care products, and toothpaste) and foods (dressing) can be used. However, the examples are not limited thereto. The stirring object has fluidity, and examples thereof include a fluid (liquid or gas), a solid in a form of particles or powder, and a mixture thereof.

The stirring device 1 according to the present embodiment is suitable for a high-viscosity (viscosity of 10,000 cP to 100,000 cP) stirring object. However, the present invention can be applied to the stirring object having a viscosity of 1,000 cP to 1,000,000 cP. The unit "cP" used in the description herein is "mPa·s" when converted to an SI unit system.

The stirring device 1 according to the present embodiment includes a circulating impeller 3, a dispersion blade 4, a guide ring 5, and a baffle 6 inside a stirring tank 2 capable of accommodating the stirring object. However, the baffle 6 is not essential in the present invention, and may not be provided. The circulating impeller 3 and the dispersion blade 4 are separately driven (multi-axis driving) by a driving part such as a motor disposed outside the stirring tank 2. In this manner, both of these are rotatable independently of each other. Therefore, both of these rotate at a suitable rotation speed in accordance with properties of the stirring object. In a case where the stirring device 1 is used for the emulsification, the circulating impeller 3 mixes and emulsifies the stirring object to form droplets. The dispersion blade 4 refines the droplets in an emulsified liquid into a small size. More specifically, the dispersion blade 4 refines the droplets by applying a shear force to a component that is in a dispersed phase in the stirring object. For example, the emulsified liquid produced by the stirring device 1 according to the present embodiment is an O/W type emulsified liquid, and a dispersed phase thereof is an oil phase. Conversely, the emulsified liquid can be a W/O type emulsified liquid, and the dispersed phase can be an aqueous phase.

The stirring tank 2 is a container having an inner peripheral wall 2*a* which is circular in cross section. An upper part of the stirring tank 2 is a cylindrical straight body part 21, and a lower part thereof is a frusto-conical throttle part 22. The straight body part 21 and the throttle part 22 are integrally formed. An inner diameter of the straight body part 21 is constant in an upward-downward direction. The throttle part 22 has an inner diameter which decreases downward. The inner diameter of the stirring tank 2 is set in this way. Accordingly, an induced flow F (refer to FIG. 3) as a downward flow of the stirring object which is generated by the rotation of the circulating impeller 3 (to be described later) can be prevented from being hindered by the inner peripheral wall 2*a* of the stirring tank 2. The throttle part 22 may have a semi-circular shape or a semi-elliptical shape in longitudinal section. An upper end part of the stirring tank 2 illustrated in FIG. 1 is open. However, the upper end part may be closed. A jacket portion 23 serving as a heater/cooler is formed outside the stirring tank 2, and a heating medium or a refrigerant passes through the jacket portion 23. In this manner, the stirring object existing inside the stirring tank 2 can be subjected to heating/heat removing (cooling).

In the present embodiment, a ribbon impeller is used as the circulating impeller 3. The circulating impeller 3 is disposed along the inner peripheral wall 2*a* of the stirring tank 2. A blade diameter (diameter) of the circulating impeller 3 can be set to 0.9 to 0.9999 as a ratio to the inner diameter of the inner peripheral wall 2*a* in the stirring tank 2. The circulating impeller 3 rotates around a vertical axis to form an induced flow F in the stirring object existing inside the stirring tank 2. This induced flow F is a partial flow that largely flows into the whole stirring tank 2. Ina case where the stirring device 1 is used for emulsification, the stirring object is mixed and emulsified by the induced flow F, thereby forming droplets.

The circulating impeller 3 according to the present embodiment is disposed along the inner peripheral wall 2*a* of the stirring tank 2, and includes two circulating impeller bodies 31 and 31 having a predetermined width, and a plurality of support rods 32 and 32 that support the two circulating impeller bodies 31 and 31 at a radially inner position. Each circulating impeller body 31 has a curved band shape. Each circulating impeller body 31 includes an upper blade 311 and a lower blade 312. The upper blades 311 are disposed at an equal interval in a circumferential direction of the straight body part 21 (interval of 180° in the present embodiment), and the lower blades 312 are disposed at an equal interval in a circumferential direction of the throttle part 22 (interval of 180° in the present embodiment). The two circulating impeller bodies 31 and 31 are rotationally symmetrically disposed at every interval of 180° across a cross-sectional center of the stirring tank 2.

Figure 2:
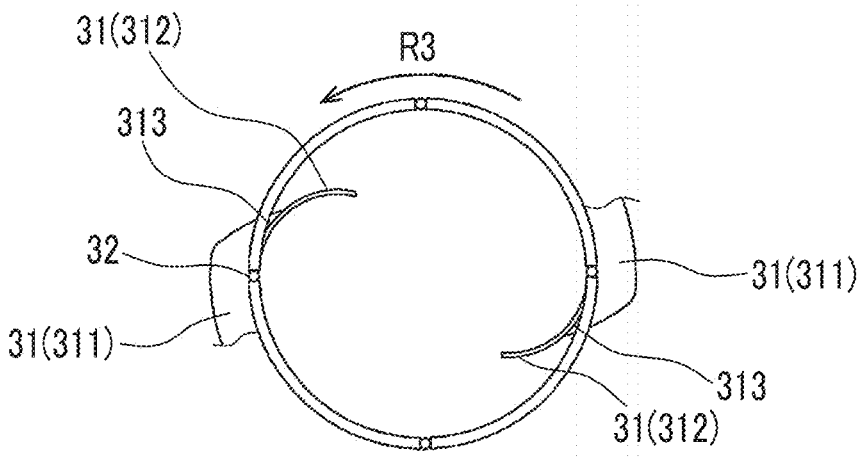
FIG. 2 is a view illustrating only a circulating impeller taken along line A-A in FIG. 1.

The upper blade 311 is disposed at a prescribed distance from the inner peripheral wall of the straight body part 21 in the stirring tank 2, and extends downward from above while being inclined at a prescribed angle in the circumferential direction. As the upper blade 311 rotates in the straight body part 21, the upper blade 311 scrapes down the stirring object, and forms the swirling downward induced flow F. The lower blade 312 is located substantially along a surface shape of the inner peripheral wall of the throttle part 22 in the stirring tank 2. As illustrated in FIG. 2, the lower blade 312 has a curved shape to bulge in a direction opposite to a rotation direction R3 in a plan view.

The upper blade 311 and the lower blade 312 are connected to each other in a joining portion 313 illustrated in FIG. 1 so that a plane direction of each blade is bent (or twisted). Specifically, as illustrated in FIG. 2, in a state where a surface of a band-shaped body configuring the lower blade 312 is in contact with a radially inner edge of a band-shaped body configuring the upper blade 311, both of these are connected to each other in the joining portion 313. In this manner, the upper blade 311 and the lower blade 312 are integrated with each other.

Figure 3:
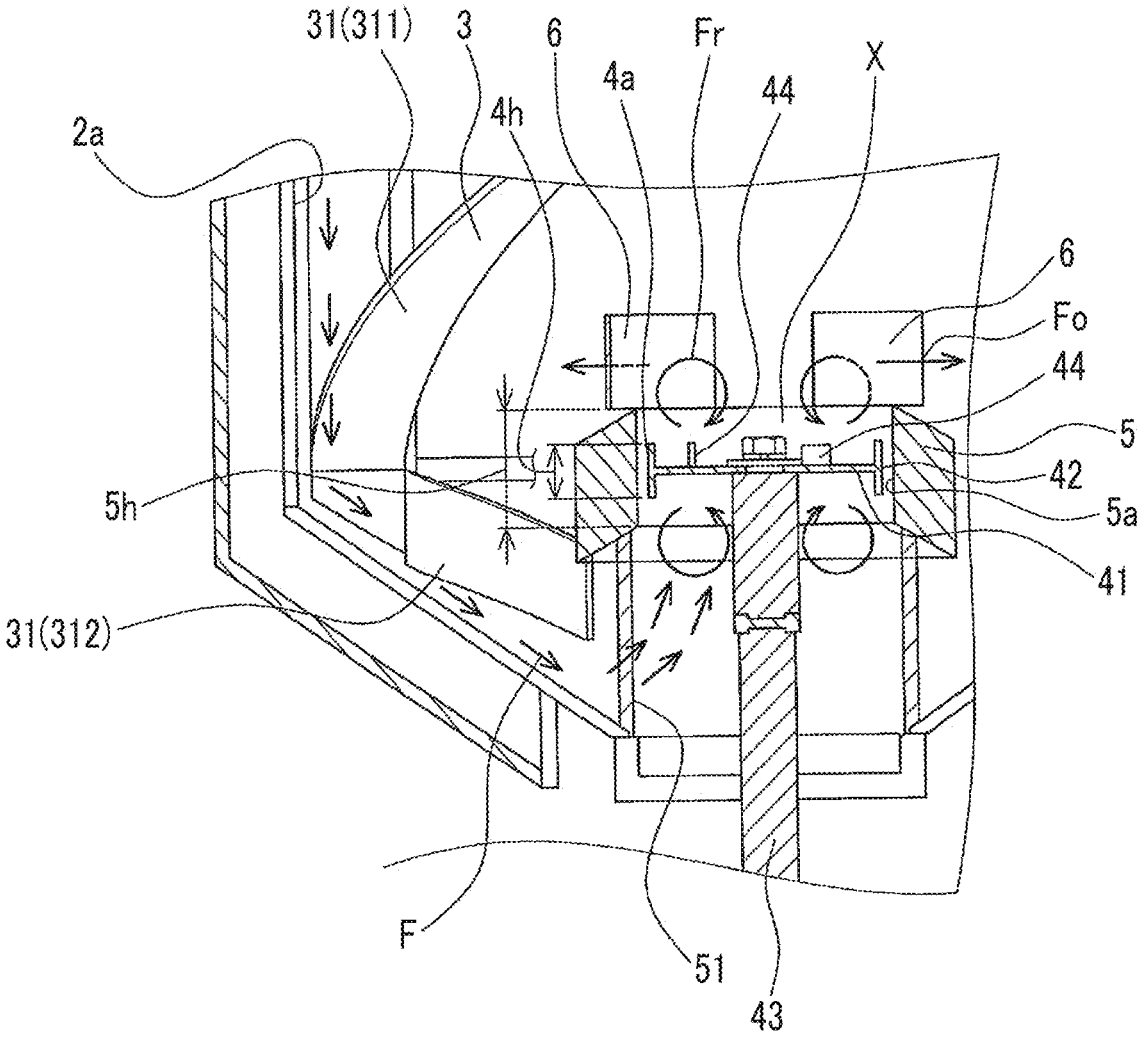
FIG. 3 is an enlarged view of a main portion which illustrates a flow of a stirring object in the stirring device.

As the lower blade 312 rotates in the rotation direction R3 in the throttle part 22, a flowing direction of the swirling downward induced flow F formed by the upper blade 311 is changed so that the induced flow F is directed downward while being directed in a radially inward direction as illustrated in FIG. 3. Therefore, the induced flow F can be guided to the dispersion blades 4 located inside the guide ring 5.

A downward facing surface of each circulating impeller body 31 is a portion that acts on the stirring object to be pushed downward. Therefore, in order to uniformly form the induced flow F, it is preferable that the downward surfacing surface of each circulating impeller body 31 is a curved surface having no step as far as possible. With regard to the prescribed distance, the inner peripheral wall 2*a* of the stirring tank 2 and the outer peripheral edge of each circulating impeller body 31 in the present embodiment have a horizontal distance of 1% to 3%, as a ratio to the inner diameter of the straight body part 21 in the stirring tank 2. However, this distance can be appropriately set in accordance with properties of the stirring object. In this way, each circulating impeller body 31 is disposed near the inner peripheral wall 2*a* of the stirring tank 2. Accordingly, each circulating impeller body 31 can reliably form the induced flow F of the stirring object along the inner peripheral wall 2*a* of the stirring tank 2.

A center axis or a center blade to which the stirring object can adhere does not exist at an internal center of the stirring tank 2. Accordingly, it is possible to prevent the stirring object from adhering to a shaft and from staying in the stirring tank 2. A width dimension of each circulating impeller body 31 is not limited to the above-described ratio, and can be appropriately set in accordance with the properties of the stirring object.

The circulating impeller bodies 31 and 31 and the support rods 32 and 32 in the circulating impeller 3 are integrated with each other by welding. Each support rod 32 is a straight rod extending in an upward-downward direction, and fixes the circulating impeller body 31 on the upper and lower sides. Each support rod 32 is connected to a circulating impeller driving part (not illustrated) disposed above the stirring tank 2 via a circulating impeller driving shaft 34. In this manner, each circulating impeller body 31 is rotatable around the vertical axis extending in the upward-downward direction via each support rod 32. A dispersion blade driving shaft 43 extending in the upward-downward direction passes through an inner portion of the radially inner end portion of the lower blade 312. As illustrated in FIG. 3, the induced flow F of the stirring object rises from a bottom portion of the throttle part 22 along the outer periphery of the dispersion blade driving shaft 43, and is guided to the plate-shaped part 41 through a radially outer position of the dispersion blade driving shaft 43.

The circulating impeller 3 rotates in the rotation direction R3 which is a counterclockwise direction in a plan view. A rotation speed is lower than a rotation speed of the dispersion blade 4. The rotation causes each circulating impeller body 31 to push the stirring object downward. Therefore, as illustrated in FIG. 3, the induced flow F that flows downward along the inner peripheral wall 2*a* of the stirring tank 2 is generated. The downward induced flow F is a flow for continuously supplying the stirring object to the dispersion blade 4 as will be described later. The downward induced flow F always exists near the inner peripheral wall 2*a* of the stirring tank 2, and the stirring object is less likely to stay in the stirring tank 2. Accordingly, the stirring object can be prevented from adhering to the inner peripheral wall 2*a* of the stirring tank 2.

The dispersion blade 4 rotates to apply a shear force to the stirring object. In a case where the stirring device 1 is used for the emulsification, the droplets formed by the circulating impeller 3 are divided and refined by the shear force.

As illustrated in FIG. 3, the dispersion blade 4 according to the present embodiment is a blade in which the outer peripheral edge of the rotatable plate-shaped part 41 has a plurality of shear teeth 42 and 42 extending in a direction intersecting a plane direction of the plate-shaped part 41 at an interval in the circumferential direction (FIG. 3 schematically illustrates only the shear teeth 42 and 42 existing in right and left end parts and a part of the fin part 44). Each shear tooth 42 is disposed along the outer peripheral edge of the plate-shaped part 41. Each shear tooth 42 is disposed to be inclined with respect to a tangential direction of the outer peripheral edge of the plate-shaped part 41. In this manner, each shear tooth 42 can form a radially outward discharge flow in the stirring object in response to the rotation of the plate-shaped part 41. The shear teeth 42 and 42 according to the present embodiment equally protrude in a forward-rearward direction (upward-downward direction) with respect to the plate-shaped part 41. However, the shear teeth 42 and 42 may protrude at least downward. The shear tooth 42 protruding in the forward direction and the shear tooth 42 protruding in the rearward direction may be alternately disposed. The shear teeth 42 and 42 can be disposed at locations other than the outer peripheral edge of the plate-shaped part 41.

Figure 4A:
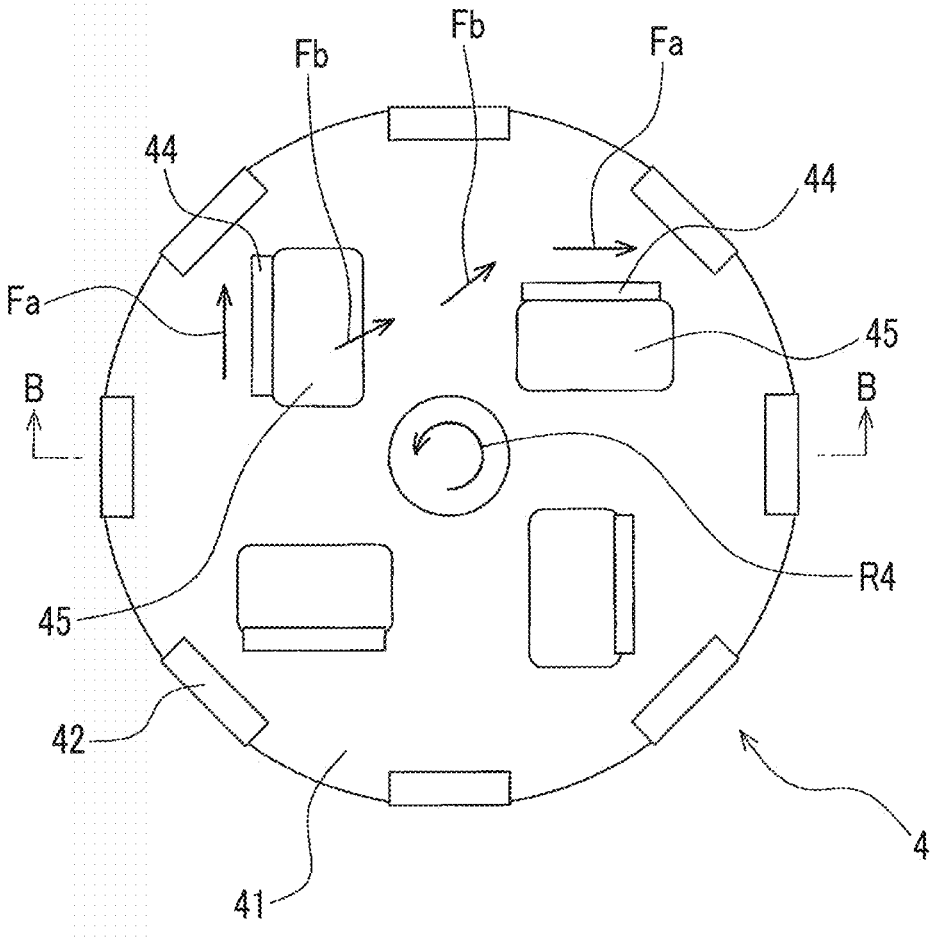
FIG. 4A is a plan view of a single dispersion blade in the stirring device.
Figure 4B:
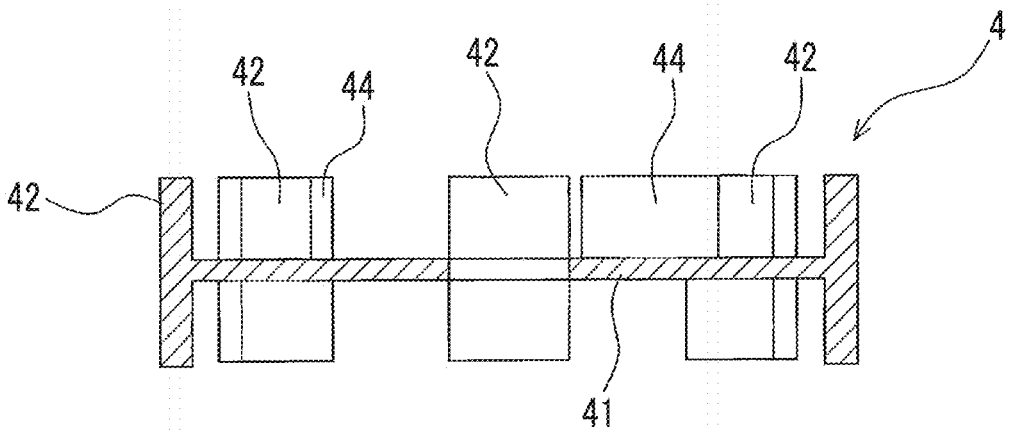
FIG. 4B is a sectional view taken along line B-B of FIG. 4A.

The plate-shaped part 41 may have a flat plate shape. However, as illustrated in FIGS. 4A and 4B, it is preferable to provide at least one fin part 44 protruding at least upward or downward from the plate-shaped part. The fin part 44 is disposed in this way. Accordingly, compared to a case where the plate-shaped part 41 simply has the flat plate shape, a stronger flow for the stirring object can be generated near the plate-shaped part 41.

Each fin part 44 according to the present embodiment has a flat plate shape perpendicular to the plate-shaped part 41. In the illustrated example, a plurality of (specifically, four) the fin parts 44 are rotationally symmetrically disposed, and all protrude upward. However, the upward protrusion is merely an example for convenience of description, and the example is not limited thereto. The plurality of fin parts 44 and 44 may all protrude downward of the plate-shaped part 41, or may alternately protrude upward and downward in the circumferential direction.

As illustrated in FIG. 4A, in each of the fin parts 44 according to the present embodiment, an extending direction of one fin part 44 in a plan view and an extending direction of another fin part 44 adjacent in the circumferential direction have a relationship in which both of these are perpendicular to each other. However, an angle formed between the fin parts 44 and 44 adjacent in the circumferential direction may be other than 90 degrees. In a relationship between the dispersion blade 4 and a rotation direction R4, a radially inner end part of the fin part 44 is located forward (rotation destination direction) in the rotation direction R4, and a radially outer end part is located rearward (rotation origin direction) in the rotation direction R4. Therefore, when the dispersion blade 4 rotates, each of the fin parts 44 can generate a flow Fa that is directed radially outward and rearward in the rotation direction (FIG. 4A).

In the dispersion blade 4 according to the present embodiment, the fin part 44 is formed by cutting out and raising a part of the plate-shaped part 41. Therefore, as the fin part 44 is formed, each through-hole 45 penetrating upward and downward is formed adjacent to a base end side position of each fin part 44 in the plate-shaped part 41. The plate-shaped part 41 is located forward (rotation destination direction) with reference to the rotation direction R4 (illustrated in FIG. 4A) of the dispersion blade 4, and the through-hole 45 is formed rearward (rotation origin direction). In the present embodiment, as illustrated in FIG. 4B, the fin part 44 is disposed at a right angle to the surface of the plate-shaped part 41. However, the present invention is not limited thereto, and the fin part 44 may be disposed to be inclined with respect to the surface of the plate-shaped part 41. In a case where the fin part 44 is disposed to be inclined, a pressing force of the fin part 44 which is applied to the stirring object can be adjusted by setting an inclination angle.

Since the dispersion blade 4 rotates, the plate-shaped part 41 is located on a side opposite to a side pushing the stirring object. Accordingly, a negative pressure is generated in each through-hole 45. The stirring object around the generated negative pressure is suctioned. As a result, a flow Fb passing through the plate-shaped part 41 in the upward-downward direction can be generated (FIG. 4A). In the present embodiment, the fin part 44 protrudes upward. Accordingly, an upward flow can be generated from below through the through-hole 45. The reason is that the fin part 44 pushes out the stirring object above the plate-shaped part 41. Therefore, a flow state of the stirring object in an area X (refer to FIG. 3) surrounded by an inner peripheral surface 5*a* of the guide ring 5 can be improved together with the flow Fa. Conversely, in a case where the fin part 44 protrudes downward, a downward flow can be generated from above through the through-hole 45.

The diameter of the dispersion blade 4 is set to 0.2 to 0.6, preferably 0.3 to 0.5, as a ratio to the inner diameter of the straight body part 21 in the stirring tank 2. In this manner, the stirring object can be guided to the dispersion blade 4 in a state where a rising force of the induced flow F is strong (a state where the rising force is not attenuated).

Since the dispersion blade 4 rotates, each shear tooth 42 collides with the stirring object. At this time, a leading edge portion of each shear tooth 42 in the rotation direction can apply the shear force to the stirring object. That is, upper and lower areas near the dispersion blade 4 including a periphery of a rotation locus of each shear tooth 42 have a high shear field. Specifically, the shear force is applied between two shear teeth 42 and 42 adjacent in the circumferential direction.

The dispersion blade driving shaft 43 extending downward is connected to the dispersion blade 4. Although not illustrated, apart between the stirring tank 2 and the dispersion blade driving shaft 43 is sealed so that the stirring object does not leak. The dispersion blade driving shaft 43 is connected to a dispersion blade driving part (not illustrated) disposed below the stirring tank 2. In this manner, the dispersion blade 4 can be rotated around the vertical axis extending in the upward-downward direction.

As described above, a circulating impeller driving part (not illustrated) for rotating the circulating impeller 3 is located above the stirring tank 2. A dispersion blade driving part for rotating the dispersion blade 4 is located below the stirring tank 2. Therefore, a shaft length of the driving shafts 34 and 43 connecting the respective driving parts and the respective blades can be reduced. It is possible to prevent the shafts from being deflected or deviated. Accordingly, it is possible to prevent vibration (resonance) when the shafts are driven. In particular, the shaft length of the dispersion blade driving shaft 43 can be reduced for the dispersion blade 4. Accordingly, the dispersion blade 4 can rotate at a high speed. It is possible to prevent the dispersion blade driving shaft 43 from having a fatigue failure caused by the vibration.

A dimension of the dispersion blade 4 from a bottom part 24 of the stirring tank 2 is smaller than a dimension of the inner diameter of the straight body part 21 in the stirring tank 2. The dispersion blade 4 is located at a radially inner position of the stirring tank 2 from the circulating impellers 3. As illustrated in FIG. 3, the dispersion blade 4 is located at a position in contact with the induced flow F formed by the circulating impellers 3, more specifically, at a position where the flow of the induced flow F is strong. Therefore, the induced flow F reliably reaches the dispersion blade 4 at a position where the induced flow F of the stirring object which is formed by the circulating impeller 3 is strong. Therefore, the stirring object is continuously supplied to the dispersion blade 4 by the circulating impeller 3. Specifically, as illustrated in FIG. 3, the induced flow F reaches the shear teeth 42 and 42 located at the blade tip from the inside of the dispersion blade 4. Accordingly, the stirring object is reliably supplied from the circulating impeller 3 to a high shear field. Therefore, even if the dispersion blade 4 rotates, a space is less likely to be formed around the dispersion blade 4, and it is possible to prevent idling of the dispersion blade 4 in the high shear field. Therefore, the stirring object can be reliably sheared by the dispersion blade 4.

Here, as described above, since the circulating impeller 3 rotates, the induced flow F that flows downward along the inner peripheral wall 2*a* of the stirring tank 2 is first generated in the straight body part 21 in the stirring object. The throttle part 22 is formed in the lower part of the stirring tank 2, and the lower blade 312 of the circulating impeller 3 rotates in the throttle part 22. Accordingly, as illustrated in FIG. 3, the induced flow F in the throttle part 22 is changed to a flow directed downward while being directed in a radially inward direction of the stirring tank 2. Therefore, the induced flow F is concentrated at the center of the lower end part of the throttle part 22. Accordingly, the flowing direction is reversed at the center of the lower end part of the throttle part 22, and the induced flow F is changed to a flow directed upward. The upward-directed induced flow F comes into contact with the dispersion blade 4 (particularly, the plate-shaped part 41).

In this way, the direction of the induced flow F is changed by the circulating impeller 3 and the inner peripheral wall 2*a* of the stirring tank 2, and the stirring object is wrapped inside in the stirring tank 2. Accordingly, the stirring object can be actively supplied to the dispersion blade 4. In a case of the emulsification, oil droplets or water droplets can be reliably refined through the shearing performed by the dispersion blades 4.

As described above, it is preferable that the stirring object is supplied to the dispersion blade 4 by the circulating impeller 3 at a position close to the rotation center (vertical axis) of the dispersion blade 4. The reason is as follows. The stirring object can be supplied to a position apart from each shear tooth 42 so that the stirring object supplied by the circulating impeller 3 is not rebounded due to the stirring object discharged by each shear tooth 42 until the stirring object reaches the dispersion blades 4. Particularly, this configuration is effective in a case where the stirring object is a highly thixotropic fluid.

Here, in the present embodiment, the circulating impeller 3 is the ribbon impeller. Therefore, for example, in order to disperse the droplets into the emulsified liquid, it is possible to provide a combination of the circulating impeller 3 and the dispersion blade 4 which include blades having a shape most suitable for refining the oil phase in the stirring object.

Both the rotation center of the circulating impeller 3 and the rotation center of the dispersion blade 4 pass through the cross-sectional center of the stirring tank 2. Compared to a form in which the rotation centers of the respective blades are shifted from each other, a configuration is adopted so that the rotation centers are concentric with each other as in the present embodiment. In this manner, the distances from the rotation center of the respective blade 3 and 4 to the inner peripheral wall 2*a* of the stirring tank 2 can be equal. Therefore, the induced flow F of the stirring object flowing from the circulating impeller 3 toward the dispersion blade 4 is uniform in the circumferential direction of the stirring tank 2. Therefore, a horizontal load applied to the dispersion blade 4 can be reduced. Accordingly, for example, it is possible to prevent the dispersion blade driving shaft 43 from being broken.

The guide ring 5 is a ring-shaped body disposed near a radially outer side of the dispersion blade 4. As illustrated in FIGS. 1 and 3, the guide ring 5 is supported from below in the throttle part 22 of the stirring tank 2 by brackets 51 and 51 extending upward and downward around the circulating impeller driving shaft 34. In this manner, the guide ring 5 is fixed to the stirring tank 2. However, the support of the guide ring 5 is not limited thereto. The guide ring 5 can be suspended from above inside the stirring tank 2, and can be fixed to the circulating impeller 3 (in this case, the guide ring 5 rotates together with the circulating impeller 3). Other supporting methods can be adopted in various ways.

The guide ring 5 has the inner peripheral surface 5*a* facing the outer peripheral edge 4*a* of the dispersion blade 4. In the present embodiment, the upper end of the inner peripheral surface 5*a* is located above the upper end of the shear tooth 42 in the dispersion blade 4, and the lower end of the inner peripheral surface 5*a* is located below the lower end of the shear tooth 42 in the dispersion blade 4. In the guide ring 5, the inner peripheral surface 5*a* and the outer peripheral surface are vertical surfaces, and the upper surface and the lower surface are inclined surfaces. A longitudinal sectional shape of the inner peripheral surface 5*a* is a parallelogram located above the outer peripheral surface. Since the guide ring 5 has this shape, an opening area of the lower end part of the guide ring 5 can be enlarged. Accordingly, the guide ring 5 is less likely to hinder the induced flow F of the stirring object directed from the circulating impeller 3 to the dispersion blade 4. Since the upper surface is an inclined surface, the stirring object is not accumulated in an area above the upper surface.

The shape of the guide ring 5 is not limited thereto. The longitudinal sectional shape can be a rectangular shape or a square shape, or a trapezoidal shape in which a longitudinal dimension of the inner peripheral surface 5*a* is larger than a longitudinal dimension of the outer peripheral surface. Conversely, the longitudinal sectional shape can be a trapezoidal shape in which a longitudinal dimension of the inner peripheral surface 5*a* is smaller than a longitudinal dimension of the outer peripheral surface. The longitudinal sectional shape can be any desired shape other than the square shape. Although the guide ring 5 according to the present embodiment is solid, the guide ring 5 may be hollow. A thickness dimension in the radial direction is not particularly limited as long as the guide ring 5 can withstand the pressure received from the stirring object. The guide ring 5 according to the present embodiment is formed in a shape continuous in the circumferential direction (ring-shaped body). However, the present invention is not limited thereto, and the guide rings 5 may be intermittently disposed at an interval in the circumferential direction.

The guide ring 5 is disposed near the radially outer side of the dispersion blade 4 in this way. Accordingly, as illustrated in FIG. 3, it is possible to generate a flow Fr which is locally wound into the rotation center (vertical axis) in the upper and lower areas of the plate-shaped part 41. Specifically, the flow Fr is a continuous rotating flow that is separated from the plate-shaped part 41 on the radially outer side in the upper and lower areas of the plate-shaped part 41 and thereafter is directed toward the plate-shaped part 41 on the radially inner side. The shear teeth 42 of the dispersion blade 4 rotating the flow Fr cross the stirring object. Accordingly, the shear teeth 42 effectively apply the shear force to the stirring object. When the fin part 44 is disposed in the dispersion blade 4 as described above, it is possible to generate a flow directed in a substantially circumferential direction in the upper and lower areas of the plate-shaped part 41. Accordingly, in addition to the flow Fr wound into the rotation center, a stronger flow can be generated. A combination of the dispersion blade 4 and the guide ring 5 according to the present embodiment does not form an entire flow inside the tank, and forms the local flow Fr. In this manner, the combination contributes to effective application of the shear force to the stirring object.

Figure 8:
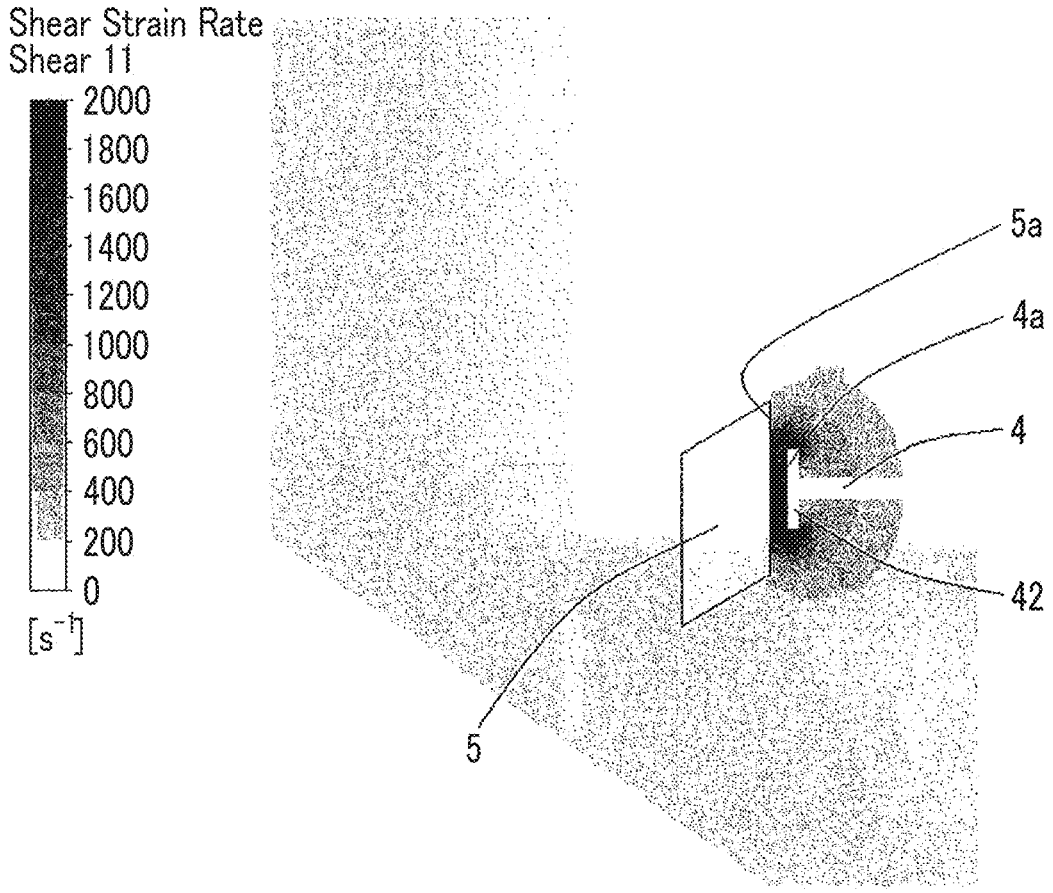
FIG. 8 is a contour diagram in which shear rates (shear strain rates) are illustrated using a dark and light display for a shear force generated in a radially outer area of the dispersion blade through a simulation, and illustrates a case where the guide ring is provided.
Figure 9:
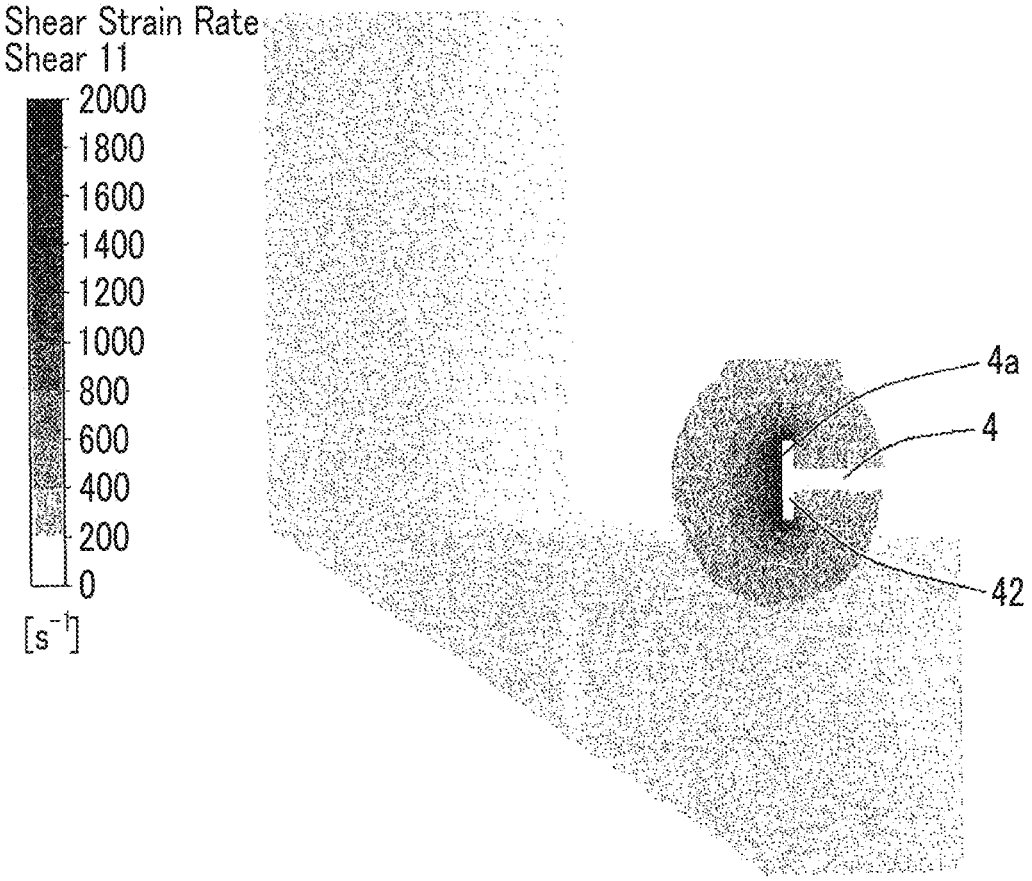
FIG. 9 is a contour diagram in which the shear rates (shear strain rates) are illustrated using the dark and light display for the shear force generated in the radially outer area of the dispersion blade through the simulation, and illustrates a case where the guide ring is not provided.

FIGS. 8 and 9 are contour diagrams in which shear rates (shear strain rates, unit: 1/s) are illustrated using a dark and light display for the shear force generated in the radially outer area of the dispersion blade 4 through a simulation. FIG. 8 illustrates a case where the guide ring 5 is provided, and FIG. 9 illustrates a case where the guide ring 5 is not provided. In each drawing, as the shear rate is higher, the shear rate is illustrated using a darker color. As will be apparent from a comparison between the drawings, in the case where the guide ring 5 is provided, it can be understood that a strong shear force can be applied to the stirring object between the inner peripheral surface 5*a* of the guide ring 5 and the outer peripheral edge 4*a* of the dispersion blade 4 (that is, the outer peripheral surface of the shear tooth 42).

A vertical dimension 5*h* on the inner peripheral surface 5*a* of the guide ring 5 is set to be larger than a vertical dimension 4*h* in the shear tooth 42 on the outer peripheral edge 4*a* of the dispersion blade 4. According to this dimensional relationship, it is possible to largely secure an area between the inner peripheral surface 5*a* of the guide ring 5 and the outer peripheral edge 4*a* of the dispersion blade 4, which is an area where a strong shear force can be applied to the stirring object. However, the dimensional relationship is not limited thereto. The vertical dimension 5*h* on the inner peripheral surface 5*a* of the guide ring 5 can be set to be the same as or smaller than the vertical dimension 4*h* in the shear tooth 42 on the outer peripheral edge 4*a* of the dispersion blade 4.

A distance between the inner peripheral surface 5*a* of the guide ring 5 and the outer peripheral edge 4*a* of the dispersion blade 4 may be any desired distance as long as the distance can form a high shear rate area as illustrated in FIG. 8. In addition, with regard to a gap between the inner peripheral surface 5*a* of the guide ring 5 and the outer peripheral edge 4*a* of the dispersion blade 4, the stirring object needs to flow into and out from the gap. However, it is not particularly essential that the stirring object passes through the gap from above to below or from below to above. In the present embodiment, the "passing through" is realized by a flow passing through the through-hole 45 of the dispersion blade 4.

Figure 5A:
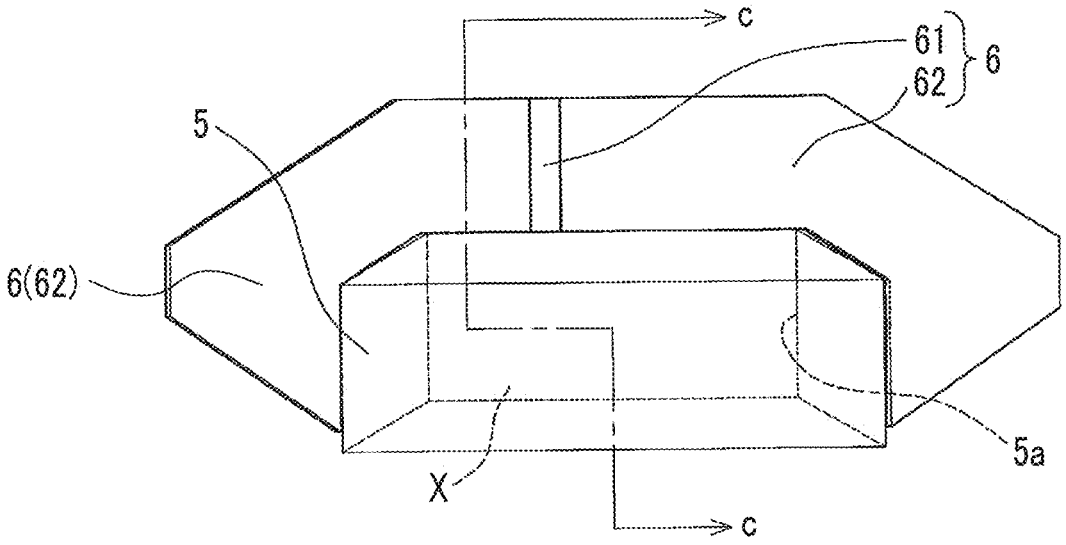
FIG. 5A is a front view illustrating a set of a guide ring, a baffle, and a support rod of the stirring device.
Figure 5B:
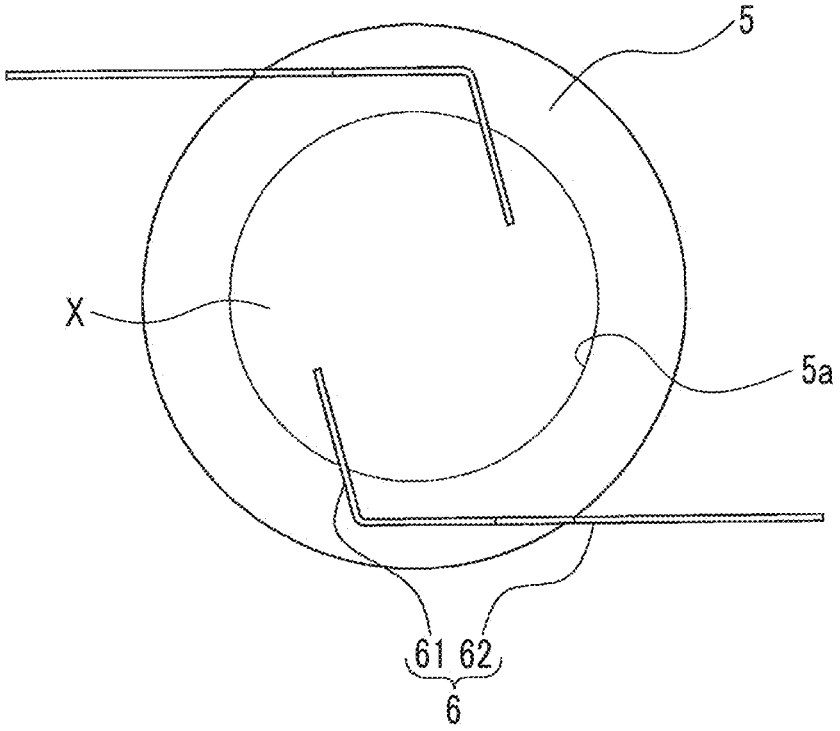
FIG. 5B is a plan view illustrating a set of the guide ring, the baffle, and the support rod of the stirring device.
Figure 5C:
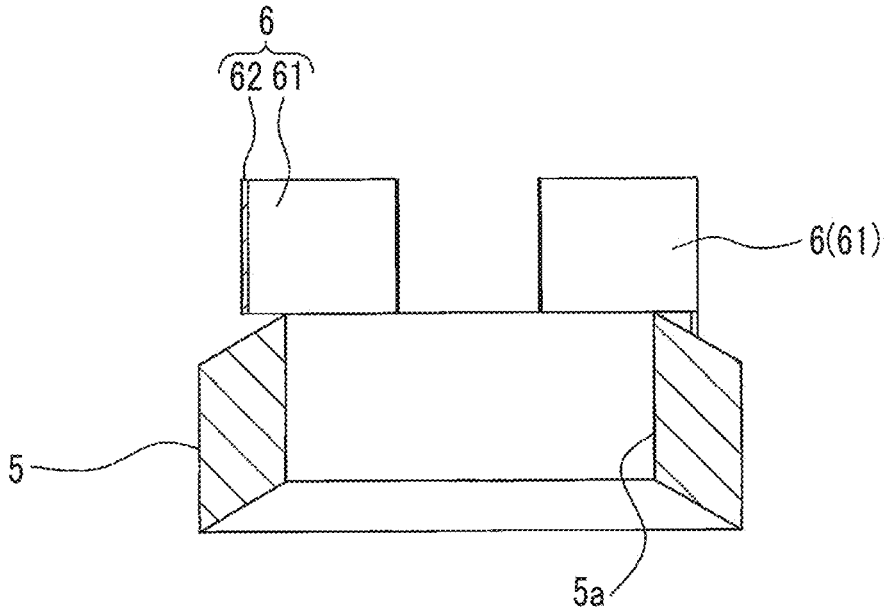
FIG. 5C is a sectional view taken along line C-C in FIG. 5A.

The baffle 6 is a plate-shaped body located above or below the guide ring 5. However, any member other than the plate-shaped body can be adopted. Various shapes can be used even if the baffle 6 is the plate-shaped body. In the present embodiment, as illustrated in FIGS. 5A, 5B, and 5C, two baffles 6 are disposed adjacent to the upper part of the guide ring 5 so as to be symmetric with each other with reference to the vertical axis. The number or disposition of the baffles 6 can be changed in various ways, and is not limited to that according to the present embodiment. The baffle 6 can be fixed to the stirring tank 2 separately from the guide ring 5. The baffle 6 is fixed to the guide ring 5. As illustrated in FIG. 3, each of the baffles 6 forms a flow Fo that continuously guides the stirring object to which the shear force is applied by the dispersion blade 4, to the radially outer position from the area X (FIG. 3) surrounded by the inner peripheral surface 5*a* of the guide ring 5. As illustrated in FIG. 5B, each of the baffles 6 has an inner piece 61 located above the area X in a plan view and an outer piece 62 bent with respect to the inner piece 61 and extending outward from the outer peripheral surface of the guide ring 5. As illustrated in FIG. 5B, the inner pieces 61 and the outer pieces 62 of the two baffles 6 and 6 are in a parallel relationship in a plan view. The inner piece 61 radially converts a strong flow in the area X surrounded by the inner peripheral surface 5*a* of the guide ring 5 which is generated by the dispersion blade 4. On the other hand, the outer piece 62 supplies the fluid to the circulating impellers 3 to convert the fluid into an entire circulation flow inside the stirring tank 2. Since the baffle 6 is disposed in this way, the strong flow generated by the dispersion blade 4 can be converted into the entire circulation flow inside the stirring tank 2. As a result, it is possible to increase a flow rate of the stirring object into the high shear field (specifically, an area near the upper and lower sides of the dispersion blade 4).

Here, the present inventor performed emulsification experiments by producing experimental stirring devices in respective forms illustrated in FIGS. 6 and 7. The experiments will be described below. The dispersion blade 4 used in this experiment does not include the fin part 44 and the through-hole 45. Experimental conditions are as follows.

Inner diameter of stirring tank: φ200 mm

Liquid volume: 2.5 L (after emulsification)

Aqueous phase: 1.5 wt % CMC (carboxymethyl-cellulose) aqueous solution ("Cellogen MP-60" manufactured by Daiichi Kogyo Pharmaceutical Co., Ltd.)

Oil phase: Liquid paraffin 125 g

Emulsifier: nonionic surfactant 0.4 g ("Tween 80" manufactured by Kishida Chemical Co., Ltd.)

Liquid viscosity: CMC aqueous solution 15,000 cP (shear rate $\gamma=10(1/s)$), final emulsified liquid 11,000 cP (shear rate $\gamma=10(1/s)$)

Outer diameter of dispersion blade: 80 mm

Rotation speed of dispersion blade: 3600 rpm

Rotation speed of ribbon impeller: 40 rpm

Figure 6A:
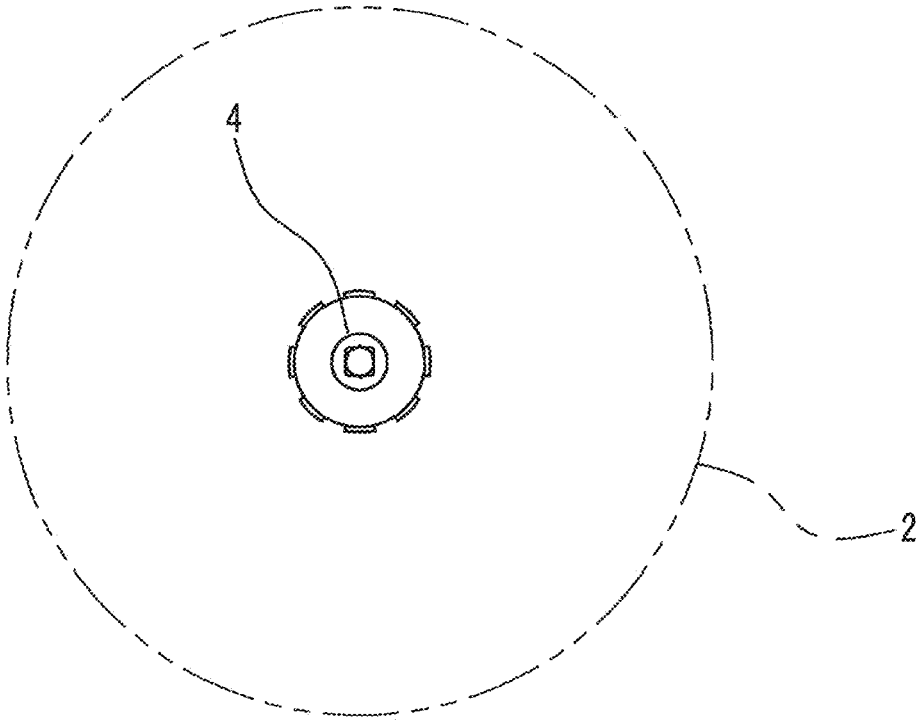
FIG. 6A is a plan view of a comparative example in which only a dispersion blade is disposed in a stirring tank.
Figure 6B:
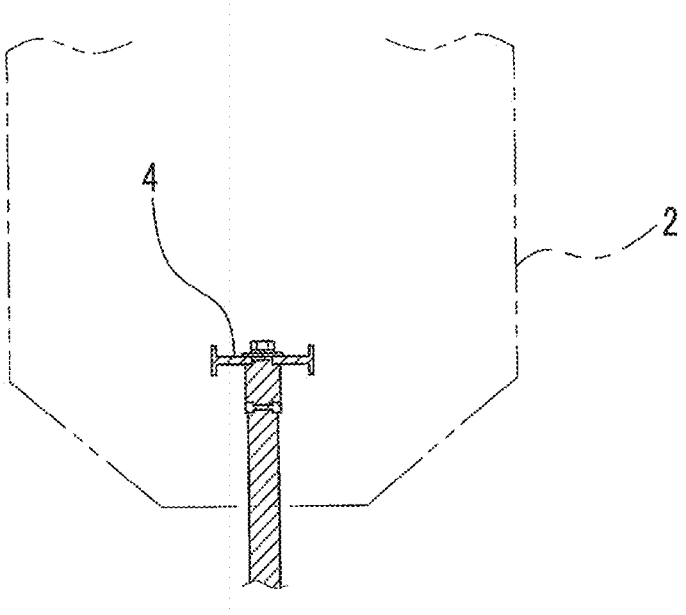
FIG. 6B is a longitudinal sectional view of a comparative example in which only the dispersion blade is disposed in the stirring tank.

As illustrated in FIGS. 6A and 6B, according to the form in which only the dispersion blade 4 is provided, the flow is generated only near the dispersion blades 4. The oil phase that is not refined partially remains in the stirring tank 2, and is insufficiently emulsified as a whole.

Figure 6C:
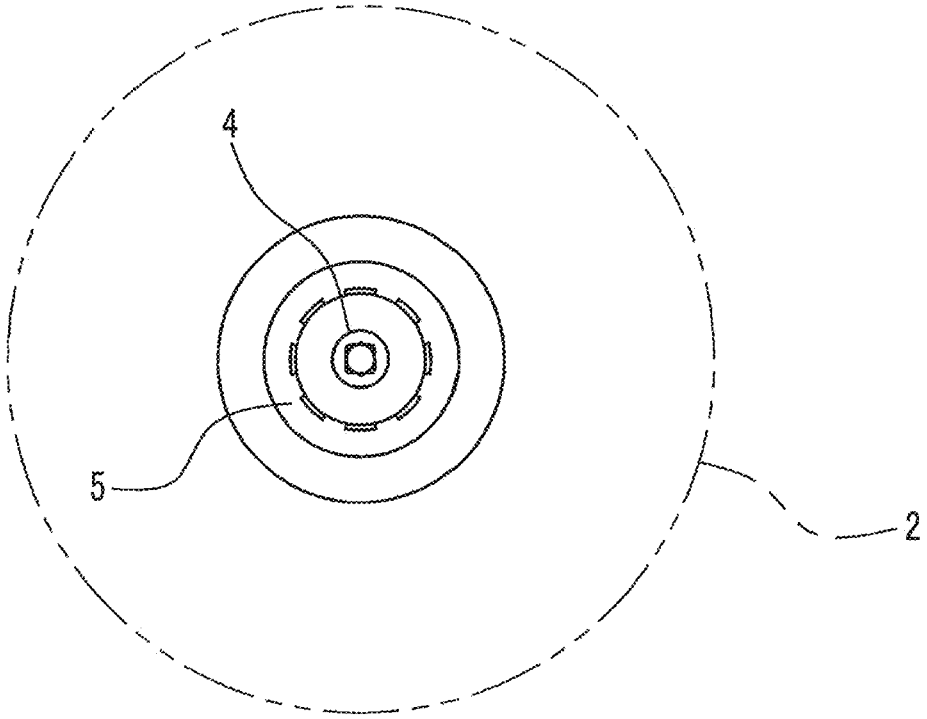
FIG. 6C is a plan view of a comparative example in which the dispersion blade and the guide ring are disposed in the stirring tank.
Figure 6D:
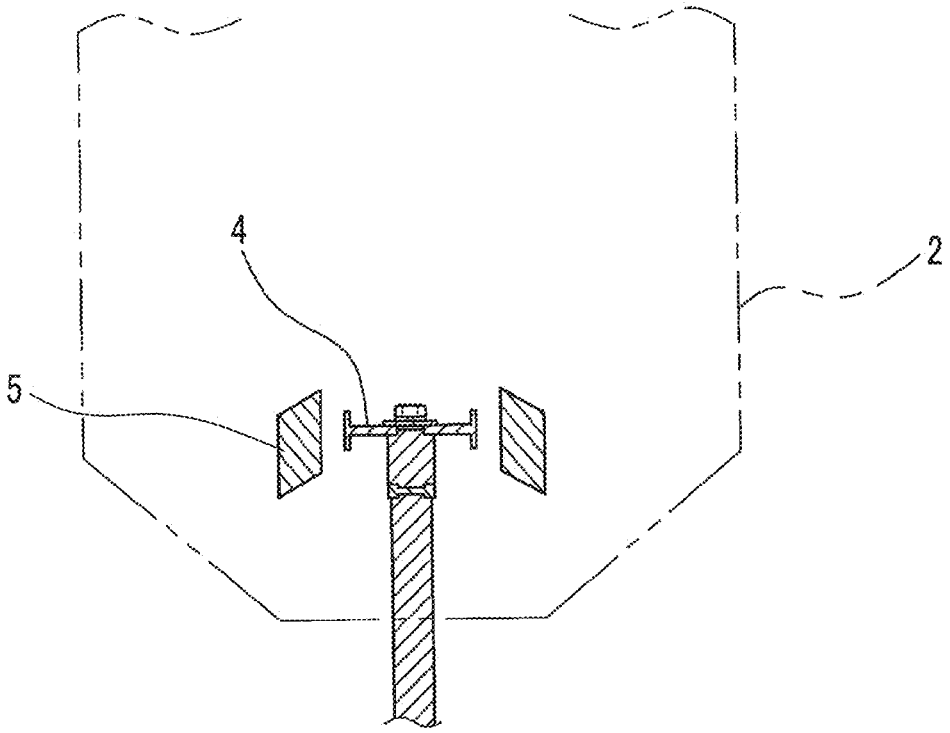
FIG. 6D is a longitudinal sectional view of a comparative example in which the dispersion blade and the guide ring are disposed in the stirring tank.

As illustrated in FIGS. 6C and 6D, according to the form in which the dispersion blade 4 and the guide ring 5 are provided, a relative droplet diameter (same applies hereinafter) based on a droplet diameter near the dispersion blade 4 in the form illustrated FIGS. 6A and 6B is approximately 70%. However, it takes 10 minutes or longer to visually confirm that the liquid inside the tank is uniformly in a clouded state (emulsified state).

Figure 7A:
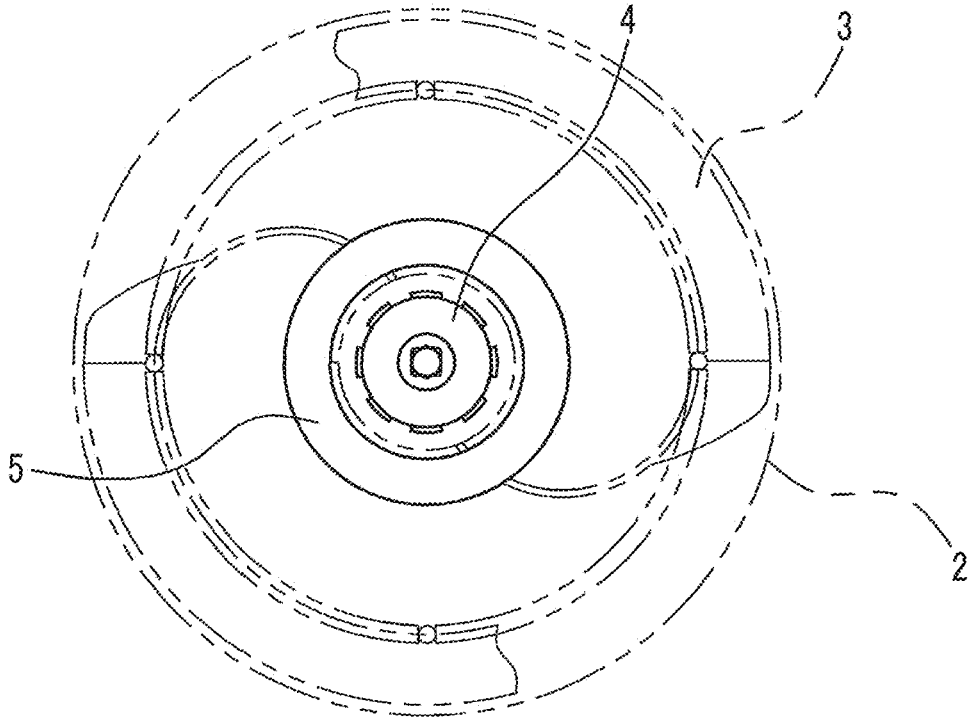
FIG. 7A is a plan view of a comparative example form in which a circulating impeller (ribbon impeller), the dispersion blade, and the guide ring are disposed in the stirring tank.
Figure 7B:
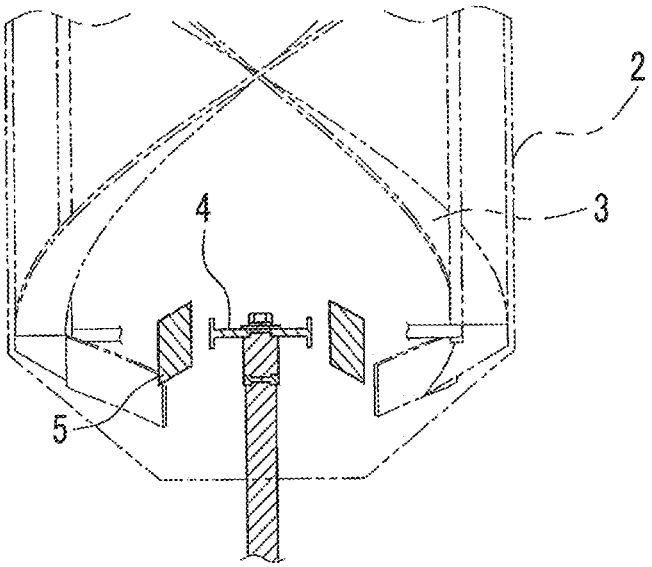
FIG. 7B is a longitudinal sectional view of a comparative example in which the circulating impeller (ribbon impeller), the dispersion blade, and the guide ring are disposed in the stirring tank.

As illustrated in FIGS. 7A and 7B, according to the form in which the circulating impeller 3 (ribbon impeller), the dispersion blade 4, and the guide ring 5 are provided, the relative droplet diameter is approximately 15%, which shows an acceptable result.

Figure 7C:
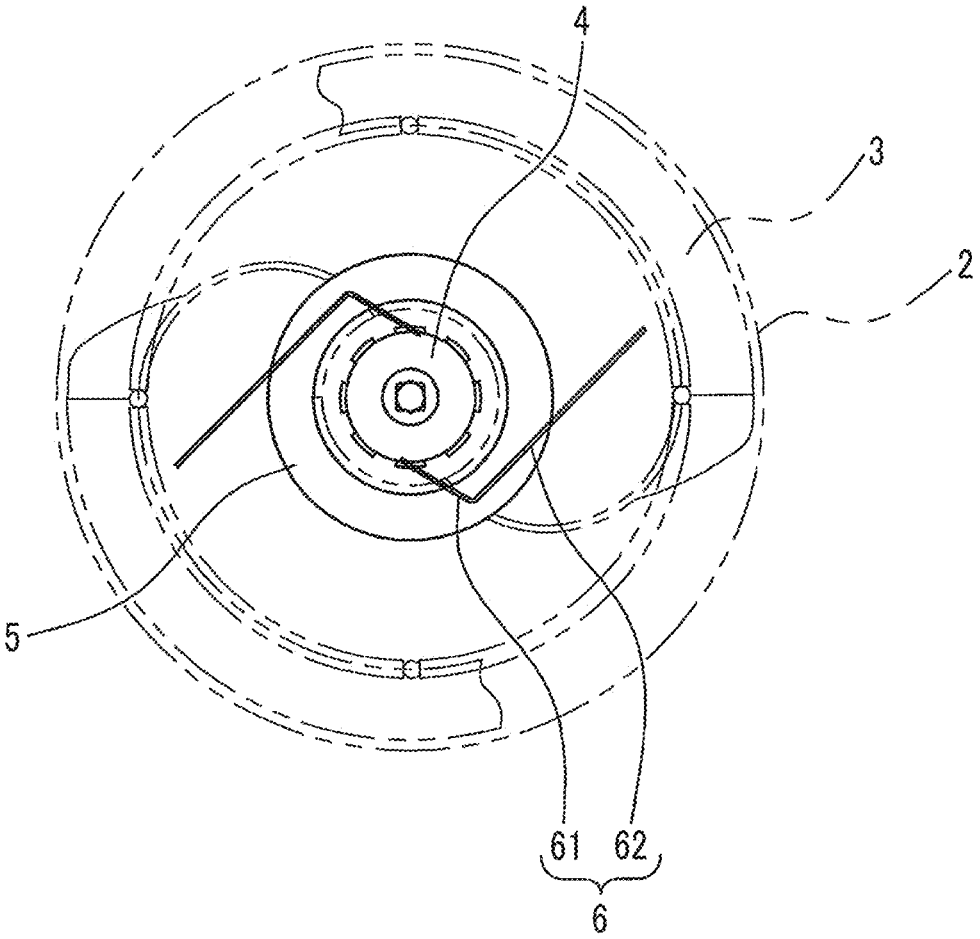
FIG. 7C is a plan view according to the present embodiment (example in which the circulating impeller (ribbon impeller), the dispersion blade, the guide ring, and the baffle are disposed in the stirring tank).
Figure 7D:
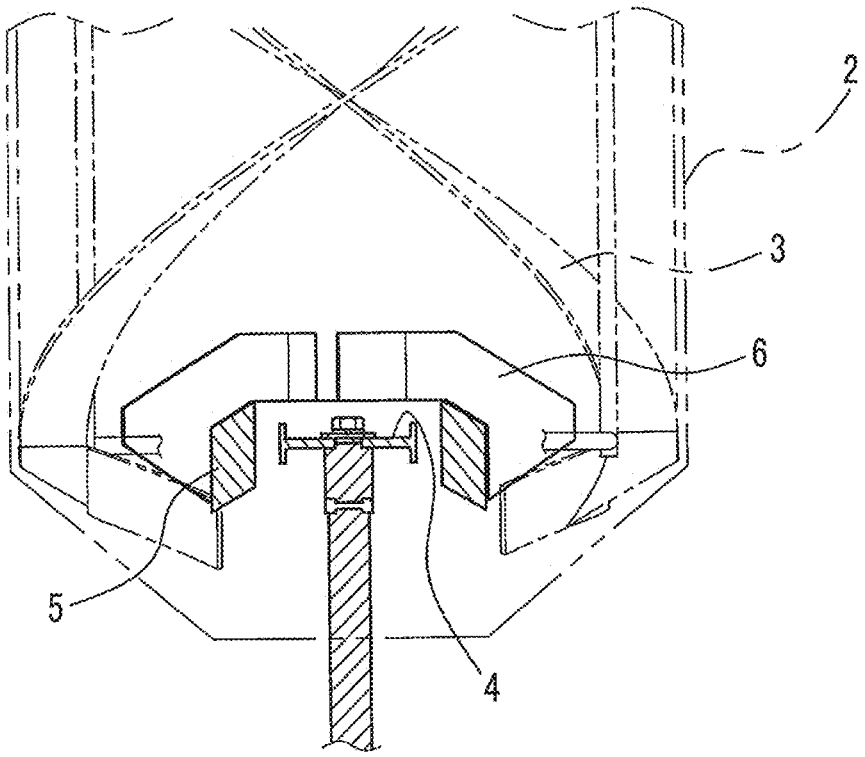
FIG. 7D is a longitudinal sectional view according to the present embodiment (example in which the circulating impeller (ribbon impeller), the dispersion blade, the guide ring, and the baffle are disposed in the stirring tank).

FIGS. 7C and 7D illustrate the present embodiment. According to the form in which the circulating impeller 3 (ribbon impeller), the dispersion blade 4, the guide ring 5, and the baffle 6 are provided, the relative droplet diameter is approximately 5%. A more satisfactory result is obtained than that according to the form illustrated in FIGS. 7A and 7B. In this form, it is visually confirmed that the whole liquid inside the tank can be uniformly emulsified within 2 minutes. It is considered as follows. Since the baffle 6 is installed, the flow generated by the dispersion blades 4 is partially converted into a circulation flow inside the tank. In this manner, the flow in the high shear field can be improved.

Figure 10:
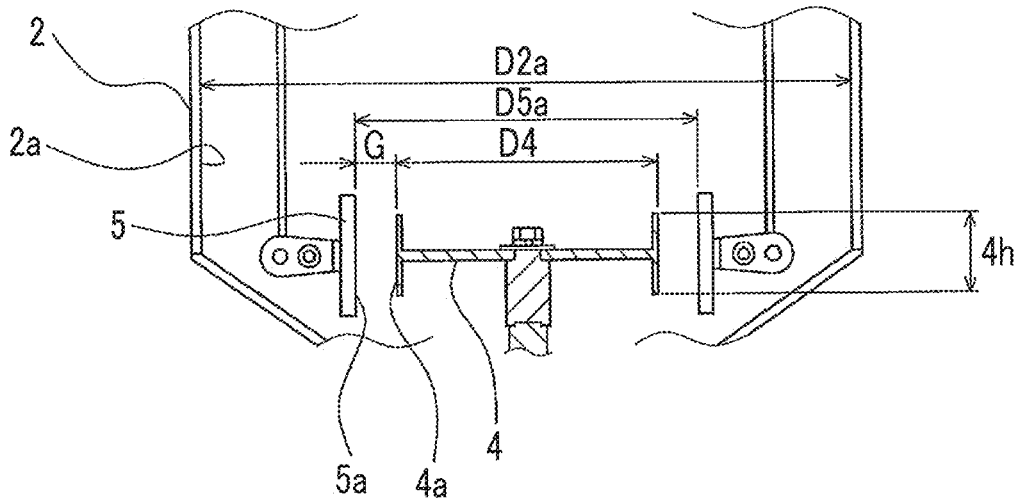
FIG. 10 is a longitudinal sectional view illustrating only a portion necessary for description, which illustrates a positional relationship between the guide ring and the dispersion blade in the stirring device used for an experiment.

The present inventor performed an emulsification experiment by producing an experimental stirring device in the form illustrated in FIG. 10. The experiment will be described below. The experimental conditions are the same as those in the above-described experiments, except for conditions described below. The experimental stirring device is operated for 20 minutes, and a particle size (D50) of the droplet in the obtained emulsified liquid is measured.

First, in the experimental stirring device, the distance (gap) between the outer peripheral edge 4*a* of the dispersion blade 4 and the inner peripheral surface 5*a* of the guide ring 5 is set in the following four patterns (A) to (D). The vertical dimension 5*h* on the inner peripheral surface 5*a* of the guide ring 5 is set to a prescribed dimension (35 mm).

(A) Inner diameter of guide ring 5 is 88 mm (gap is 4 mm)
(B) Inner diameter of guide ring 5 is 98 mm (gap is 9 mm)
(C) Inner diameter of guide ring 5 is 106 mm (gap is 13 mm)
(D) Inner diameter of guide ring 5 is 116 mm (gap is 18 mm)

Figure 11:
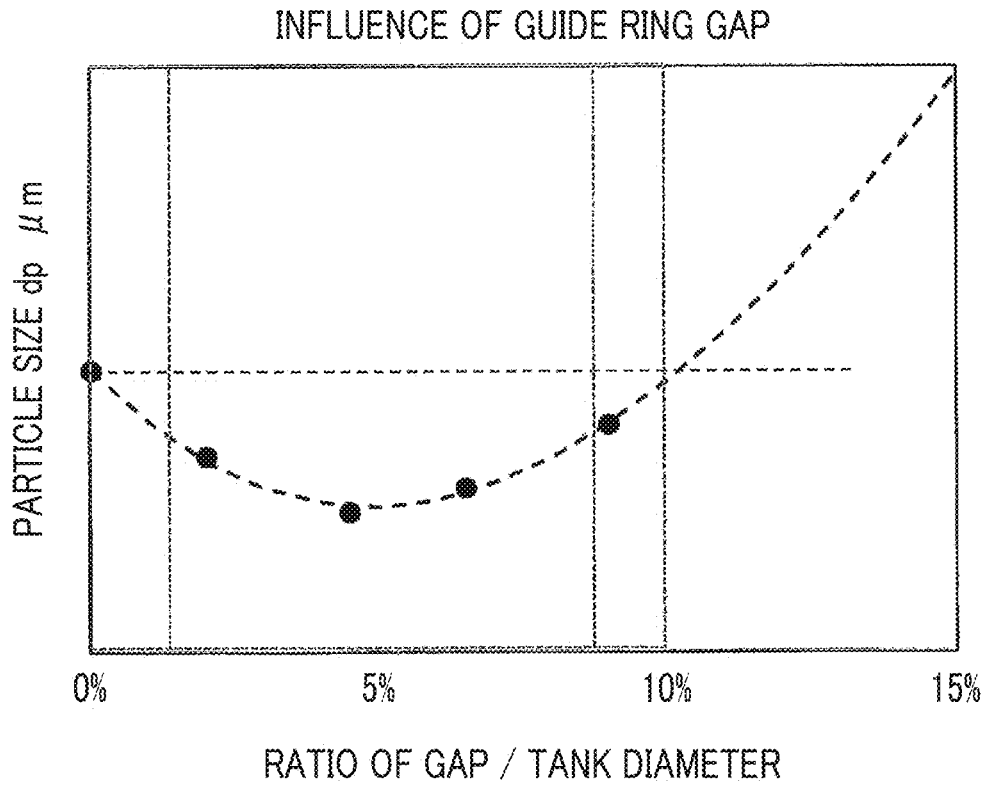
FIG. 11 is a graph illustrating a relationship between a gap (tank diameter ratio) between the guide ring and the dispersion blade and a particle size which are obtained through an experiment.

The results are illustrated by a graph in FIG. 11. A horizontal axis represents a percentage of a radial distance G between the outer peripheral edge 4*a* of the dispersion blade 4 and the inner peripheral surface 5*a* of the guide ring 5 (½ of a difference between a diameter D5*a* of the inner peripheral surface 5*a* of the guide ring 5 and a diameter D4 of the outer peripheral edge 4*a* of the dispersion blade 4) with respect to a diameter D2*a* on the inner peripheral wall 2*a* in the stirring tank 2 (illustrated as a "ratio of gap/tank diameter"), and a vertical axis represents a particle size. The experiment is performed in a state where the guide ring 5 is not attached, and this case is plotted at 0% on the horizontal axis. Referring to FIG. 11, the following is understood. It is preferable that the radial distance G between the outer peripheral edge 4*a* of the dispersion blade 4 and the inner peripheral surface 5*a* of the guide ring 5 exceeds 0%, and is equal to or smaller than 10% of the diameter D2*a* of the inner peripheral wall 2*a* in the stirring tank 2. More preferably, the radial distance G can be 2% to 9%, and particularly preferable, the radial distance G can be 3% to 7%.

Next, in the experimental stirring device, the vertical dimension 5*h* on the inner peripheral surface 5*a* of the guide ring 5 is set in the following four patterns (E) to (H). The diameter of the inner peripheral surface 5*a* of the guide ring 5 (inner diameter of the guide ring 5) is set to a prescribed dimension (106 mm). The vertical dimension 4*h* of the outer peripheral edge 4*a* of the dispersion blade 4 in the shear tooth 42 is set to a prescribed dimension (22 mm). As illustrated in FIG. 10, the center of the guide ring 5 in the upward-downward direction and the center of the dispersion blade 4 in the upward-downward direction are set to coincide with each other.

Figure 12:
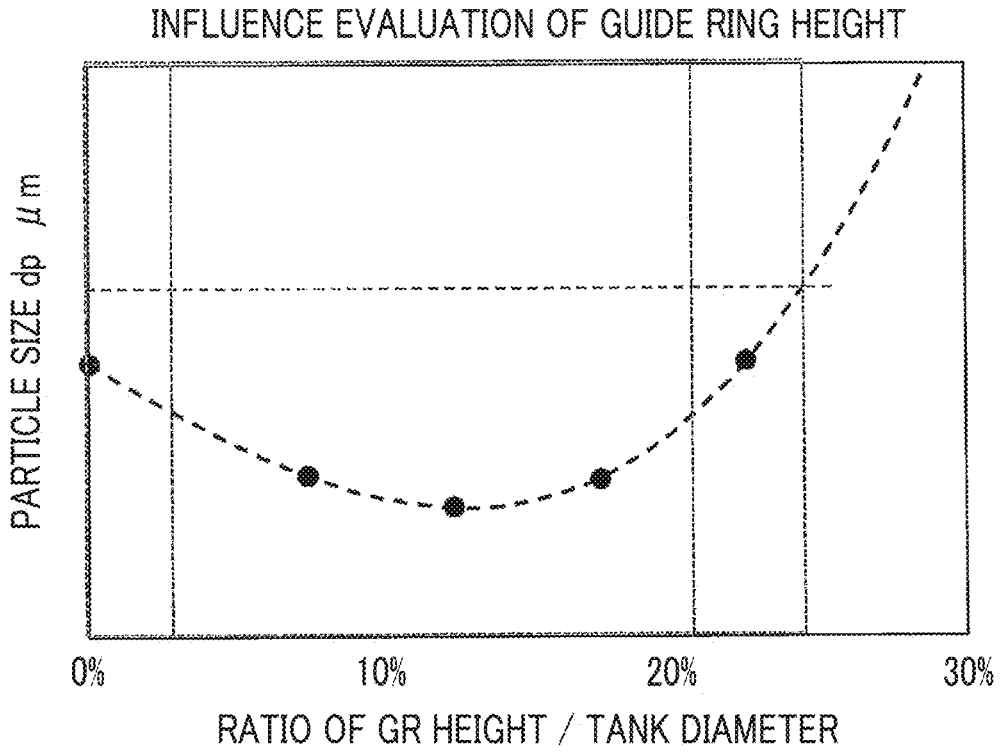
FIG. 12 is a graph illustrating a relationship between a vertical dimension (tank diameter ratio) of the guide ring and the particle size which are obtained through an experiment.

(E) Vertical dimension 5*h* of guide ring 5 is 15 mm
(F) Vertical dimension 5*h* of guide ring 5 is 25 mm
(G) Vertical dimension 5*h* of guide ring 5 is 35 mm
(H) Vertical dimension 5*h* of guide ring 5 is 45 mm The results are illustrated by a graph in FIG. 12. The horizontal axis represents a percentage of the vertical dimension 5*h* on the inner peripheral surface 5*a* of the guide ring 5 with respect to the diameter D2*a* of the inner peripheral wall 2*a* in the stirring tank 2 (illustrated as a "ratio of GR height/tank diameter"), and the vertical axis represents the particle size. The experiment is performed in a state where the guide ring 5 is not attached, and this case is plotted at 0% on the horizontal axis. Referring to FIG. 12, the following is understood. It is preferable that the vertical dimension 5*h* on the inner peripheral surface 5*a* of the guide ring 5 exceeds 0%, and is equal to or smaller than 25% of the diameter of the inner peripheral wall 2*a* in the stirring tank 2. More preferably, the vertical dimension 5*h* can be 2% to 21%.

The induced flow F of the stirring object formed by the circulating impeller 3 can reach the dispersion blade 4 by the stirring device 1 according to the present embodiment configured as described above. Accordingly, the stirring object is continuously supplied from the circulating impeller 3 to the dispersion blade 4. Therefore, a space is less likely to be formed around the rotating dispersion blade 4. Furthermore, the strong shear force can be applied to the stirring object in the area between the dispersion blade 4 and the guide ring 5. Furthermore, the flow of the stirring object inside the tank can be satisfactorily balanced by the baffle 6. Therefore, in the high viscosity area (viscosity of 10,000 cP to 100,000 cP), it is possible to produce a stable emulsified liquid that is not separated over a long period of time. Moreover, in the related art, in some operation cases, the viscosity is lowered by raising the temperature of the stirring object. However, the stirring device 1 according to the present embodiment can be operated at room temperature. Therefore, it is possible to solve the following disadvantages in the related art. A large amount of power and a longer processing time are required for heating and cooling, or a long time is required for cleaning work since the number of components in the device increases.

The stirring device according to the present invention is not limited to the embodiment. The present invention can be modified in various ways within the scope not departing from the concept of the present invention.

For example, the circulating impeller 3 is the ribbon impeller in the embodiment, but is not limited thereto. The circulating impeller 3 can be realized in various forms as long as the circulating impeller 3 adopts the following configuration. One or more inclined circulating impeller bodies 31 are disposed inside the stirring tank 2. As each of the circulating impeller bodies 31 moves (rotates in the embodiment) inside the stirring tank 2, the stirring object is pushed downward. Each of the circulating impeller bodies 31 may have a curved plate (band) shape as in the embodiment, or may have a flat plate shape.

In a case where the ribbon impeller is used as the circulating impeller 3, the present invention is not limited to the following configuration. As in the embodiment, the two circulating impeller bodies 31 are disposed for the upper blade 311 at an equal interval (interval of 180° in the embodiment) in the circumferential direction, and are disposed for the lower blade 312 at an equal interval (interval of 180° in the embodiment) in the circumferential direction. A disposition range of the circulating impeller bodies 31 can be set to any desired angle of 90° to 360°, and the number of the circulating impeller bodies 31 can be set to any desired number of one, three, or more.

A plurality of dispersion blades 4 can be disposed in multiple stages in the upward-downward direction. In this case, a shape of the dispersion blade 4 in each stage may vary. A plurality of circulating impellers 3 can be provided. In a case where the plurality of dispersion blades 4 are disposed in multiple stages in the upward-downward direction, it is preferable that a plurality of guide rings 5 are disposed corresponding to the dispersion blades 4 in each stage, instead of continuously providing the guide rings 5 in the upward-downward direction.

In the dispersion blade 4 according to the embodiment, the through-hole 45 is formed together with the fin part 44 by cutting out a part of the plate-shaped part 41. However, for example, only the fin part 44 can be formed by welding a separate plate-shaped body to the plate-shaped part 41.

The stirring device 1 according to the present embodiment performs batch processing. However, without being limited thereto, the stirring device 1 can perform continuous processing by continuously supplying the stirring object into the stirring tank.

A configuration and an operation of the embodiment will be summarized below. In the embodiment, the stirring device 1 includes the stirring tank 2 having the inner peripheral wall 2*a* which is circular in cross section, at least one ribbon impeller 3 and at least one dispersion blade 4 which are located inside the stirring tank 2 and rotatable around the vertical axis independently of each other, and the guide ring 5 disposed near the radially outer side of the dispersion blade 4. Rotation centers of the ribbon impeller 3 and the dispersion blade 4 are concentric with each other. The ribbon impeller 3 is disposed along the inner peripheral wall 2*a* of the stirring tank 2, and rotates around the vertical axis to form at least the downward flow F in the stirring object existing inside the stirring tank 2. The dispersion blade 4 rotates to apply the shear force to the stirring object, and is disposed at the radially inner position of the stirring tank 2 from the ribbon impeller 3, and at the position in contact with the flow F of the stirring object, which is formed by the ribbon impeller 3. The guide ring 5 has the inner peripheral surface 5*a* facing the outer peripheral edge 4*a* of the dispersion blade 4.

According to this configuration, the dispersion blade 4 rotates inside the guide ring 5. In this manner, the strong shear force can be applied to the stirring object between the inner peripheral surface 5*a* in the guide ring 5 and the outer peripheral edge 4*a* of the dispersion blade 4. Moreover, the stirring object can be continuously supplied to the dispersion blade 4 by the ribbon impeller 3. Accordingly, the flow of the stirring object inside the tank can be satisfactorily balanced.

The dispersion blade 4 can include the rotating plate-shaped part 41, the shear teeth 42 and 42 disposed in the outer peripheral edge of the plate-shaped part 41 at an interval in the circumferential direction, and at least one fin part 44 protruding at least upward or downward from the plate-shaped part 41.

According to this configuration, the fin part 44 in the dispersion blade 4 can generate a strong flow in the stirring object near the plate-shaped part 41.

The dispersion blade 4 can include at least one through-hole 45 adjacent to the fin part 44 and penetrating the plate-shaped part 41.

According to this configuration, the negative pressure is generated in the through-hole 45 by the fin part 44 in the dispersion blade 4. In this manner, a flow that passes through the plate-shaped part 41 in the upward-downward direction can be generated in the stirring object.

The vertical dimension 5*h* of the guide ring 5 on the inner peripheral surface 5*a* may be larger than the vertical dimension 4*h* of the outer peripheral edge 4*a* of the dispersion blade 4.

According to this configuration, it is possible to largely secure an area between the inner peripheral surface 5*a* of the guide ring 5 and the outer peripheral edge 4*a* of the dispersion blade 4, which is an area where a high shear force can be applied to the stirring object.

In addition, a baffle 6 located above or below the guide ring 5 is provided, and the baffle 6 guides the stirring object to which the shear force is applied by the dispersion blade 4 to the radially outer position from an area surrounded by the inner peripheral surface 5*a* of the guide ring 5.

According to this configuration, the stirring object can be continuously guided to the radially outer position from the area surrounded by the inner peripheral surface 5*a* of the guide ring 5 by the baffle 6. Accordingly, the flow of the stirring object inside the tank is more satisfactorily balanced.

The radial distance G between the outer peripheral edge 4*a* of the dispersion blade 4 and the inner peripheral surface 5*a* of the guide ring 5 can exceed 0%, and can be equal to or smaller than 10% of the diameter (inner diameter) D2*a* of the inner peripheral wall 2*a* in the stirring tank 2.

According to this configuration, for example, in a case where the stirring device 1 is used for the emulsification, the particle size of the particles dispersed in the processed emulsified liquid can be refined.

The vertical dimension 5*h* on the inner peripheral surface 5*a* of the guide ring 5 can exceed 0% and can be equal to or smaller than 25% of the diameter D2*a* of the inner peripheral wall 2*a* in the stirring tank 2.

According to this configuration, for example, in a case where the stirring device 1 is used for the emulsification, the particle size of the particles dispersed in the processed emulsified liquid can be refined.

In the embodiment, the strong shear force can be applied to the stirring object. Moreover, the flow of the stirring object inside the tank can be satisfactorily balanced. Therefore, it is possible to provide the stirring device particularly suitable for the high-viscosity stirring object.

It should be understood that the invention is not limited to the above-described embodiment, but may be modified into various forms on the basis of the spirit of the invention. Additionally, the modifications are included in the scope of the invention.

What is claimed is:

1. A stirring device comprising:

a stirring tank comprising an inner peripheral wall which is circular in cross section;

a circulating impeller and a dispersion blade which are located inside the stirring tank and rotatable around a vertical axis independently of each other; and a guide ring disposed near a radially outer side of the dispersion blade, wherein rotation centers of the circulating impeller and the dispersion blade are concentric with each other, wherein the circulating impeller is disposed along the inner peripheral wall of the stirring tank, and rotates around the vertical axis to form at least a downward flow in a stirring object existing inside the stirring tank, wherein the dispersion blade rotates to apply a shear force to the stirring object, and is disposed at a radially inner position of the stirring tank from the circulating impeller, and at a position in contact with a flow of the stirring object, which is formed by the circulating impeller, wherein the guide ring includes an inner peripheral surface facing an outer peripheral edge of the dispersion blade, and wherein a vertical dimension on the inner peripheral surface of the guide ring exceeds 0%, and is equal to or smaller than 25% of a diameter of the inner peripheral wall in the stirring tank.

2. The stirring device according to claim 1, wherein the dispersion blade comprises a rotating plate-shaped part, shear teeth disposed in an outer peripheral edge of the plate-shaped part at an interval in a circumferential direction, and at least one fin part protruding at least upward or downward from the plate-shaped part.

3. The stirring device according to claim 2, wherein the dispersion blade comprises at least one through-hole adjacent to the fin part and penetrating the plate-shaped part.

4. The stirring device according to claim 1, wherein the vertical dimension on the inner peripheral surface of the guide ring is larger than a vertical dimension in the outer peripheral edge of the dispersion blade.

5. The stirring device according to claim 1, further comprising:

a baffle located above or below the guide ring, wherein the baffle is configured to guide the stirring object to which the shear force is applied by the dispersion blade, to a radially outer position from an area surrounded by the inner peripheral surface of the guide ring.

6. The stirring device according to claim 1, wherein a radial distance between the outer peripheral edge of the dispersion blade and the inner peripheral surface of the guide ring exceeds 0%, and is equal to or smaller than 10% of the diameter of the inner peripheral wall in the stirring tank.

7. The stirring device according to claim 1, wherein a dispersion blade driving shaft extending downward is connected to the dispersion blade, and the dispersion blade driving shaft is rotated by a dispersion blade driving part disposed below the stirring tank.

8. The stirring device according to claim 1, further comprising:

a bracket fixed to a throttle part of the stirring tank and fixing and supporting the guide ring to the stirring tank.

9. The stirring device according to claim 1, wherein the circulating impeller is rotated by a circulating impeller driving part disposed above the stirring tank via a circulating impeller driving shaft.

10. The stirring device according to claim 1, wherein the guide ring is formed in a shape continuous in a circumferential direction.

* * * * *